US006836268B1

(12) United States Patent
Song

(10) Patent No.: US 6,836,268 B1
(45) Date of Patent: Dec. 28, 2004

(54) APPARATUS AND METHOD OF INTERFACING VIDEO INFORMATION IN A COMPUTER SYSTEM

(75) Inventor: Myoung Jun Song, Taegu-shi (KR)

(73) Assignee: LG Electronics Inc., Seoul (KR)

( * ) Notice: Subject to any disclaimer, the term of this patent is extended or adjusted under 35 U.S.C. 154(b) by 67 days.

(21) Appl. No.: 09/628,503

(22) Filed: Jul. 28, 2000

(30) Foreign Application Priority Data

Jul. 31, 1999 (KR) ..... P1999-31588

(51) Int. Cl.[7] ..... G09G 5/00

(52) U.S. Cl. ..... 345/204; 345/699; 348/521; 348/540

(58) Field of Search ..... 345/204, 698, 345/699; 348/521, 540, 542

(56) References Cited

U.S. PATENT DOCUMENTS

| | | | | |
|---|---|---|---|---|
| 4,739,313 A | | 4/1988 | Oudshoorn et al. | 340/703 |
| 4,841,289 A | | 6/1989 | Kambayashi et al. | 340/703 |
| 5,150,109 A | | 9/1992 | Berry | 340/811 |
| 5,276,458 A | * | 1/1994 | Sawdon | 345/698 |
| 5,457,473 A | * | 10/1995 | Arai et al. | 345/10 |
| 5,532,719 A | * | 7/1996 | Kikinis | 345/211 |
| 5,579,029 A | | 11/1996 | Arai et al. | 345/132 |
| 5,812,210 A | | 9/1998 | Arai et al. | 348/555 |
| 5,986,636 A | * | 11/1999 | Wu | 345/691 |
| 6,219,023 B1 | | 4/2001 | Kim | 345/127 |
| 6,377,251 B1 | * | 4/2002 | Takasu et al. | 345/204 |

FOREIGN PATENT DOCUMENTS

| | | | |
|---|---|---|---|
| CN | 1175856 A | 3/1998 | |
| EP | 0456923 A1 | 11/1991 | G09G/1/16 |
| GB | 2 235 358 A | 2/1991 | 3/153 |
| GB | 2314493 A | 12/1997 | G09G/1/16 |
| JP | 05-232918 | 9/1993 | |
| JP | 05-341750 | 12/1993 | |
| JP | 11-015425 | 1/1999 | |
| WO | WO 95/19620 | 7/1995 | G09G/5/00 |

OTHER PUBLICATIONS

Vivitron 1776 Monitor—Video Display—User's Guide, Gateway 2000, 1994 151FS and 171FS Color Monitors—User's Guide, Compaq, 1993, pp. 2–4–2–7.

* cited by examiner

*Primary Examiner*—Jimmy H. Nguyen
(74) *Attorney, Agent, or Firm*—Fleshner & Kim, LLP

(57) ABSTRACT

An apparatus and method of interfacing video information which can provide an accurately displayed video picture irrespective of the type of a video input signal by interfacing the video display information between a main body and a monitor, and thus maintaining the optimum picture state. The apparatus includes a main body for outputting a video signal and information on a display type of the video signal, and a monitor for detecting the display type of the corresponding video signal in accordance with the display type information outputted from the main body and displaying on a display screen the video signal outputted from the main body to match the detected display type.

25 Claims, 4 Drawing Sheets

| recognition code | | data |
|---|---|---|
| bit 7 | bit 6 | bit 5 ~ bit 0 bit 7 ~ bit 0 |
| 0 | 0 | the number of dots in a horizontal period |
| 0 | 1 | the number of backporches in a horizontal period |
| 1 | 0 | the number of horizontal lines in a vertical period |
| 1 | 1 | the number of horizontal lines of backporch in a vertical period |

APPARATUS AND METHOD OF INTERFACING VIDEO INFORMATION IN A COMPUTER SYSTEM

BACKGROUND OF THE INVENTION

1. Field of the Invention

The present invention relates to a computer system, and more particularly to an apparatus and method of interfacing video information in a computer system.

2. Background of the Related Art

A related art computer system, as shown in FIG. 1, includes a main body 1, such as a personal computer (PC) or a work station. The main body 1 performs various kinds of information operations and information processing, and generates a video signal for a displaying corresponding processed contents on a display screen. A monitor 2 receives horizontal and vertical sync signals H-sync/V-sync and a RGB video signal outputted from the main body 1, as shown in FIG. 2. The monitor thus displays a corresponding image, and performs various kinds of information interface with the main body 1 through serial data (SDA) and serial clock (SCL) lines of a display data channel (DDC).

The monitor 2 comprises a microcomputer 11 for detecting the display type of an input video signal by analyzing frequency information of the horizontal and vertical sync signals. The monitor 2 outputs a control signal so that the RGB video signal transmitted from the main body 1 is processed using the same format as the corresponding display format, or in a form that corresponds to the closest factory mode. The monitor 2 further includes a video processing section 12 for processing the RGB video signal transmitted from the main body 1, to match the corresponding display type in accordance with the control signal from the microcomputer 11. Finally, a display section 13 displays an output of the video processing section on the display screen.

The operation of the related art computer system as constructed above will be described. First, the main body 1 of the computer system transmits the horizontal and vertical sync signals, as well as the RGB video signal to the monitor 2.

The microcomputer 11 in the monitor 2 detects the type of the input video signal in accordance with the frequencies of the horizontal and vertical sync signals, and controls the video processing section 12. This allows the input video signal to be displayed in a factory mode which is closest to the video type among factory modes predetermined in the monitor 2. The video processing section 12 processes the input video signal to match the factory type determined by the microcomputer 11, and displays the input video signal through the display section.

In the case of an analog type cathode ray tube (CRT) monitor, the factory mode corresponds to a table of the image type corresponding to the frequency information of the horizontal and vertical sync signals. Specifically, that includes an active video frequency for one horizontal period, a backporch time for one horizontal period, the total number of horizontal lines for one vertical period, and a backporch time for one vertical period, among others.

For a digital type liquid crystal display (LCD) monitor, the factory mode corresponds to a table of the image type corresponding to the frequency information of the horizontal and vertical sync signals. Specifically, that includes the total number of dots for one horizontal period, the number of backporches for one horizontal period, the total number of horizontal lines for one vertical period, and the number of backporches for one vertical period, among others.

The main body 1 transmits only the RGB video signal and the horizontal and vertical sync signals to the monitor 2. This, however, is not enough for the monitor 2 to detect the type of the video signal transmitted from the main body 1. In order to actually display the video signal, such as the above-described video type, information regarding the active video frequency for one horizontal period and the like is required.

Accordingly, the factory mode, which has the video types corresponding to the representative horizontal and vertical sync signal frequencies listed in table, is applied to the respective monitor 2. The frequency of the horizontal and vertical sync signals transmitted from the main body 1 is compared with the frequency of the horizontal and vertical sync signals of the predetermined factory mode, and if the same horizontal and vertical sync signal frequency exists, the video signal is displayed using the video type corresponding to the horizontal and vertical sync signal frequency.

If, on the other hand, the same horizontal and vertical sync signal frequency does not exist in the table, the video signal is displayed using the video type corresponding to the frequency closest to the frequency of the horizontal and vertical sync signals transmitted from the main body 1.

Thus, according to the related art computer system, if the frequency of the horizontal and vertical sync signals transmitted from the main body does not coincide with that of the predetermined factory mode in the monitor, the position or size of the displayed picture will become abnormal, and a normal picture desired by the user cannot be outputted.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

Another object of the present invention is to provide a device and method of interfacing video information in a computer system that substantially obviates one or more of the problems due to limitations and disadvantages of the related art.

Another object of the present invention is to provide a device and method of interfacing video information in a computer system which can provide an accurately displayed picture regardless of the type of input video signal, by interfacing the display video information between the main body and the monitor.

To achieve these objects and other advantages, in whole or in parts, and in accordance with the purpose of the present invention, as embodied and broadly described, the apparatus for interfacing video information in a computer system according to one embodiment comprises a main body for outputting a video signal and information on a display type of the video signal, and a monitor for detecting the display type of the corresponding video signal in accordance with the display type information outputted from the main body, and displaying on a display screen the video signal outputted from the main body to match the detected display type.

In another embodiment of the present invention, there is provided an apparatus for interfacing video information in a computer system comprising a monitor for outputting video type information of the video signal that can be displayed by the monitor, and displaying on a display screen a video signal externally inputted in the corresponding video type, and a main body for converting a display type of the video signal to match the video type information outputted from the monitor, and outputting the video signal to the monitor.

In still another embodiment of the present invention, there is provided a method of interfacing video information in a computer system having a monitor and a main body for outputting horizontal and vertical sync signals and a video signal to the monitor, and performing data transmission/reception with the monitor through a communication line, the method comprising the steps of the main body including display type information of the video signal in communication data, and transmitting to the monitor the communication data including the display type information along with the horizontal and vertical sync signals and the video signal, and the monitor detecting a display type of the video signal transmitted from the main body using the display type information, and displaying on a display screen the video signal to match the display type.

In still another embodiment of the present invention, there is provided a method of interfacing video information in a computer system having a monitor and a main body for outputting horizontal and vertical sync signals and a video signal to the monitor, and performing data transmission/reception with the monitor through a communication line, the method comprising the main body including display type information of the video signal in at least one of the horizontal sync signal and the video signal, and transmitting to the monitor the horizontal and vertical sync signals having display type information and the video signal, and the monitor detecting a display type of the video signal transmitted from the main body using the display type information, and displaying on a display screen the video signal to match the display type.

In still another embodiment of the present invention, there is provided a method of interfacing video information in a computer system having a monitor and a main body for outputting horizontal and vertical sync signals and a video signal to the monitor, and performing data transmission/reception with the monitor through a communication line, the method comprising the steps of the main body dividing display type information of the video signal, including divided display type information in the horizontal sync signal and the vertical sync signal, respectively, and transmitting to the monitor the horizontal and vertical sync signals including the divided display type information and the video signal, and the monitor detecting a display type of the video signal transmitted from the main body using the display type information, and displaying on a display screen the video signal to match the display type.

In still another embodiment of the present invention, there is provided a method of interfacing video information in a computer system having a monitor and a main body for outputting horizontal and vertical sync signals and a video signal to the monitor, and performing data transmission/reception with the monitor through a communication line, the method comprising the steps of the monitor transmitting to the main body information on a display type of the video signal that can be displayed by the monitor, the main body converting a type of the video signal to match the display type information transmitted from the monitor, and the monitor displaying the video signal transmitted from the main body.

To further achieve the above-described objects of the present invention in a whole or in parts, there is provided an apparatus for interfacing video information that includes a main body, which outputs a video signal and corresponding display information, and a monitor, which detects a display type of the corresponding video signal in accordance with the display information, and displays the video signal outputted from the main body in accordance with the detected display type.

To further achieve the above-described objects of the present invention in a whole or in parts, there is provided a video interface that includes a main body, which outputs a video signal through a video signal line, and outputs information relating to the video signal display type through a communication line, and a monitor, which detects the display type of the corresponding video signal in accordance with the display type information, and displays the video signal outputted from the main body in accordance with the detected display type.

To further achieve the above-described objects of the present invention in a whole or in parts, there is provided an apparatus for interfacing video information in a computer system that includes a main body, which outputs a video signal, a horizontal sync signal and a vertical sync signal at least one of which carries video signal display information, and a monitor, which detects the type of display for the corresponding video signal in accordance with the display information, and displays the outputted video signal in accordance with the detected display type.

To further achieve the above-described objects of the present invention in a whole or in parts, there is provided a video interface that includes a main body, which provides information relative to a display type of a video signal embedded in a video signal, a horizontal sync signal and a vertical sync signal, and outputs the video signal, the horizontal sync signal and the vertical sync signals, and a monitor which detects the display type of the corresponding video signal in accordance with the display type information outputted from the main body, and displays the video signal in accordance with the detected display type.

To further achieve the above-described objects of the present invention in a whole or in parts, there is provided an apparatus for interfacing video information in a computer system includes a monitor, which outputs data identifying a video type of a video signal that can be displayed by the monitor, and displays the video signal externally inputted in a corresponding video type, and a main body, which converts a display type of the video signal to match the video type data outputted from the monitor, and outputs the converted video signal to the monitor.

To further achieve the above-described objects of the present invention in a whole or in parts, there is provided a method of interfacing video information that includes transmitting video signal display type information for a main body to a monitor through one of the horizontal and vertical sync signals, a video signal, and communication data, and detecting a display type of the video signal transmitted from the main body using the video signal display type information, and displaying the video signal to match the display type.

To further achieve the above-described objects of the present invention in a whole or in parts, there is provided a method of interfacing video information that includes transmitting display type information of the video signal in at least one of the horizontal sync signal and the video signal to a monitor, and detecting a display type of the transmitted video signal using the display type information.

To further achieve the above-described objects of the present invention in a whole or in parts, there is provided a method of interfacing video information that includes dividing display type information of a video signal, embedding the divided display type information into the horizontal sync signal and the vertical sync signal, respectively, transmitting to a monitor the horizontal and vertical sync signals having the divided display type information, along with the video signal, decoding and reassembling the display type information, and detecting a display type of the transmitted video signal using the reassembled display type information.

To further achieve the above-described objects of the present invention in a whole or in parts, there is provided a method of interfacing video information that includes transmitting display type information of a video signal from a monitor to a main body, receiving the display type information and converting a type of video signal based on the received information to match a display type of the monitor, and displaying on the monitor the video signal transmitted from the main body.

To further achieve the above-described objects of the present invention in a whole or in parts, there is provided an apparatus for interfacing video information that includes a monitor which transmits information regarding a display type of a video signal through a display data channel, and a computer converting the display type of the video signal based on the information received from the monitor through the display data channel and transmitting the converted video signal with horizontal and vertical sync signals to the monitor.

To further achieve the above-described objects of the present invention in a whole or in parts, there is provided an apparatus for interfacing video information that includes a computer transmitting horizontal and vertical sync signals, serial data signal and serial clock signal through a display data channel and a video signal, and a monitor receiving the horizontal and vertical sync signals, serial data signal and serial clock signal through the display data channel and the video signal, wherein a display type information of the video signal is included in one of the serial data signal of the display data channel, and the horizontal sync signal.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Reference will now be made in detail to the preferred embodiments of the present invention, examples of which are illustrated in the accompanying drawings. First, the video information interfacing apparatus in a computer system according to the first and second embodiments of the present invention will be described.

First Embodiment

Figure 1:
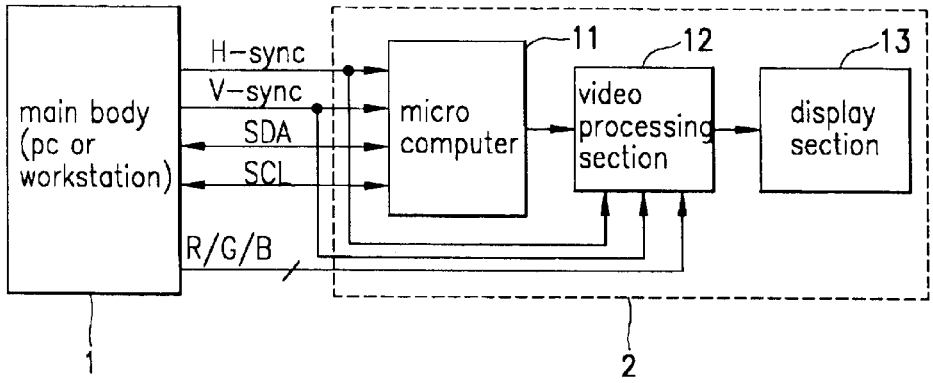
FIG.1 Related Art
FIG. 1 is a block diagram illustrating the construction of a related art computer system.
Figure 2:
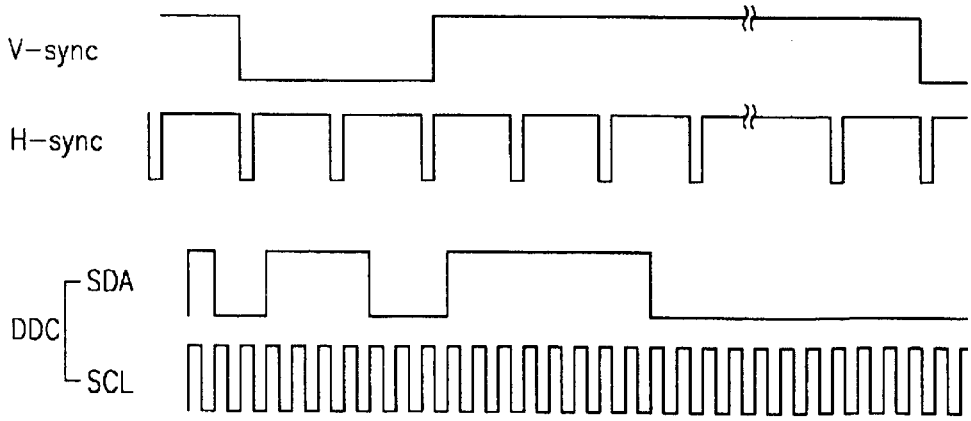
FIG.2 Related Art
FIG. 2 is a waveform diagram of horizontal and vertical sync signals and SDA/SCL signals of FIG. 1.
Figure 3:
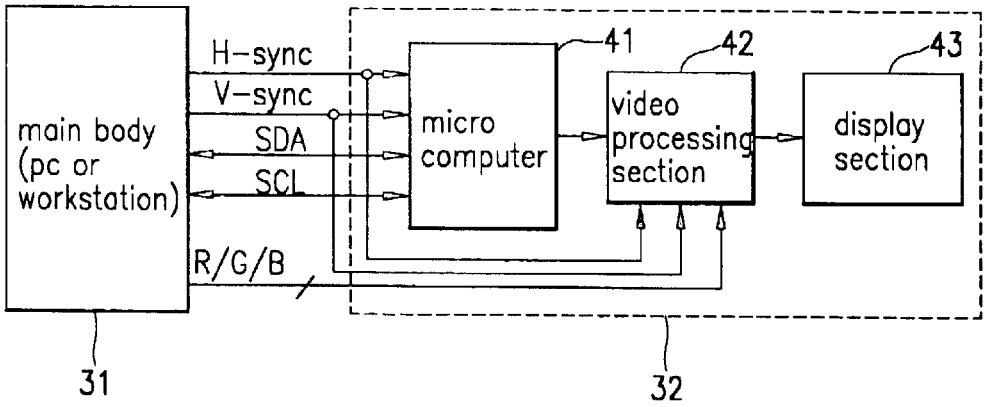
FIG. 3 is a block diagram illustrating the video information interfacing apparatus in a computer system according to a first embodiment of the present invention.

As shown in FIG. 3, the video information interfacing apparatus in a computer system according to the first embodiment includes a main body 31, such as a PC or a workstation, for example, which generates and outputs a RGB video signal and horizontal and vertical sync signals for displaying a picture. The main body 31 also outputs display type information of the RGB video signal through a display data channel (DDC (SDA/SCL)) for interfacing various kinds of information. The apparatus further includes a monitor 32, for detecting a display type of the corresponding video signal in accordance with the display type information outputted from the main body 31, and displaying on a display screen the video signal to match the display type.

The monitor 32 comprises a control circuit 41, such as a microcomputer 41, which detects the type of the RGB video signal in accordance with the display type information transmitted from the main body 31. The microcomputer 41 outputs a control signal so that the RGB video signal will be processed in accordance with the corresponding display type. The monitor 31 further includes a video processing section 42, for processing the RGB video signal transmitted from the main body 31 in accordance with the control signal from the microcomputer 41. This allows the RGB video signal to be displayed on the display screen. Finally, the monitor 32 includes a display section 43 for displaying an output of the video processing section 42 on the display screen.

The operation of the video information interfacing apparatus according to the first embodiment of the present invention will now be described.

First, the main body 31 transmits the horizontal and vertical sync signals and the RGB video signal to the monitor 32. Simultaneously, the main body 31 includes the RGB video signal display type information in the serial data (SDA), horizontal sync signal, or RGB video signal, and transmits the display type information to the monitor 32.

The display type information preferably includes the number of dots for a horizontal period, the number of backporches for a horizontal period, the number of horizontal lines for a vertical period, and the number of horizontal lines of the backporch for a vertical period, among other information.

The microcomputer 41 in the monitor 32 detects the display type of the RGB video signal transmitted from the main body 31 in accordance with the display type information, and outputs a control signal to the video processing section 42. This allows the RGB video signal to be processed in accordance with the detected display type.

The video processing section 42 processes and outputs to the display section 43 the RGB video signal in accordance with the control signal from the microcomputer 31 so that the RGB video signal can be displayed. The display section 43 then displays the output of the video processing section 42 on the display screen.

Second Embodiment

Figure 4:
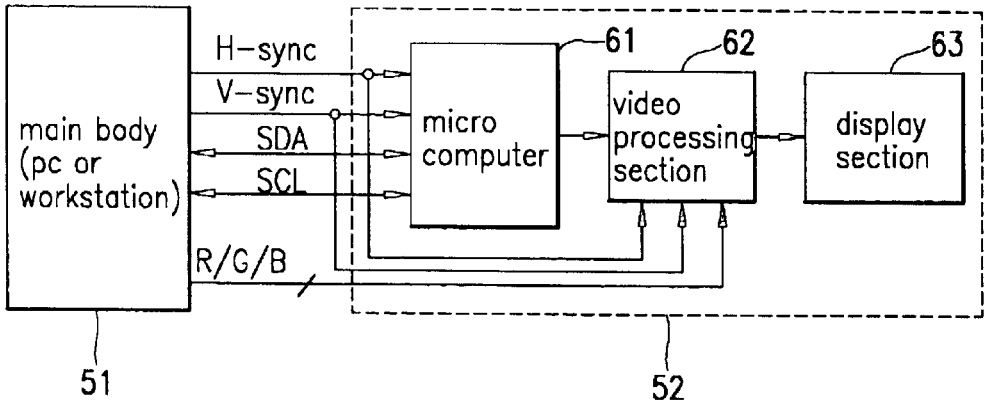
FIG. 4 is a block diagram illustrating the video information interfacing apparatus in a computer system according to a second embodiment of the present invention.

As shown in FIG. 4, the video information interfacing apparatus according to the second embodiment includes a monitor 52, which outputs display type information of an RGB video signal that can be displayed by the monitor, such as a factory mode, for example. The monitor 52 also displays on a display screen an externally inputted RGB video signal in the corresponding display type. A main body 51 converts the display type of the RGB video signal to match the display type information outputted from the monitor 52, and outputs the RGB video signal to the monitor 51.

The monitor 52 includes a microcomputer 61, which detects the type of the RGB video signal transmitted from the main body 51 and outputs a control signal. The control signal allows the RGB video signal to be processed in the corresponding factory mode. A video processing section 62 processes the RGB video signal transmitted from the main body 51 in accordance with the control signal from the microcomputer 61 so that the RGB video signal can be displayed on the display screen. A display section 63 then displays an output of the video processing section 62 on the display screen.

The operation of the video information interfacing apparatus according to the second embodiment of the present invention will now be described.

First, the microcomputer 61 in the monitor 52 transmits information regarding the display type of the video signal, such as the display type of the predetermined factory mode, to the main body 51 through the serial data line (SDA).

Then, the main body 51 converts the display type of the RGB video signal to match the display type outputted from the monitor 52. In this way, the RGB video signal can be normally displayed in the monitor 52. The main body 51 then transmits the converted RGB video signal to the monitor 52 along with the horizontal and vertical sync signals.

The microcomputer 61 in the monitor 52 consequently detects the display type of the RGB video signal, and outputs the control signal to the video processing section 62, allowing the RGB video signal to be displayed in the corresponding type.

The video processing section 62 then processes and outputs the RGB video signal to the display section 63 in accordance with the control signal from the microcomputer 61. Thus, the RGB video signal can be displayed on the display screen, and the display section 63 displays the corresponding video signal on the display screen.

Hereinafter, the video information interfacing method in a computer system according to the first, second, third, and fourth embodiments of the present invention will be described.

First Embodiment

Figure 5:
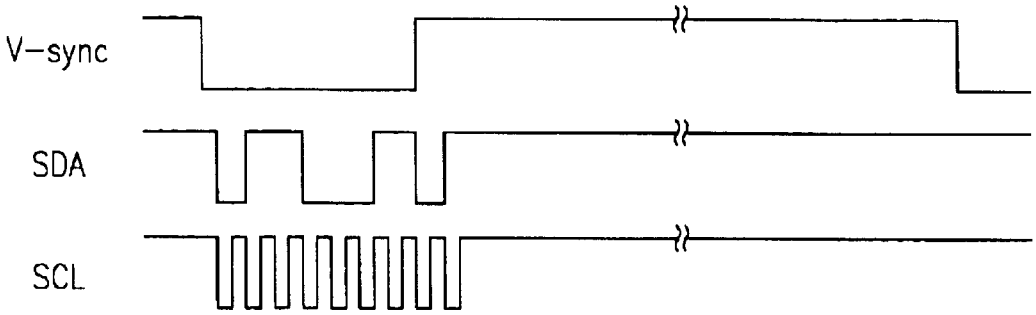
FIG. 5 is a waveform diagram showing the operation of the video information interfacing apparatus in a computer system according to the first embodiment of the present invention.

According to the video information interfacing method in a computer system according to the first embodiment of the present invention, as shown in FIG. 5, the main body synchronizes the display information of the RGB video signal with the vertical sync signal, carries the synchronized display type information on the serial data (SDA), and transmits to the monitor the serial data (SDA) along with the serial clock pulse (SCL). Accordingly, the monitor reads the serial data according to the serial clock pulse using the vertical sync signal as an enable signal.

The monitor then detects the display type information carried on the serial data, and displays the RGB video signal to match the corresponding type.

Second Embodiment

Figure 6:
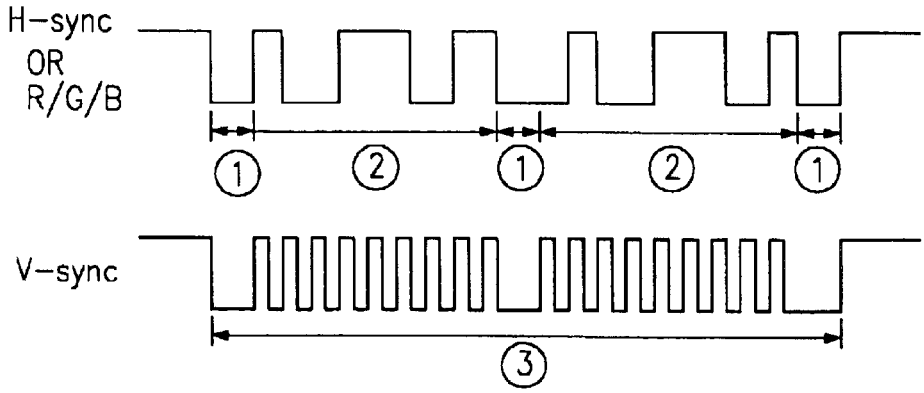
FIG. 6 is a waveform diagram showing the operation of the video information interfacing apparatus in a computer system according to second and third embodiments of the present invention.

According to the video information interfacing method in a computer system according to the second embodiment of the present invention, as shown in FIG. 6, the main body carries the display type information ② of the RGB video signal on any one of the horizontal sync signal, the R video signal, the G video signal, and the B video signal. In this way, the display type information is preferably synchronized with the vertical sync signal ③. The main body also carries the display type information on the horizontal sync signal, and transmits the display type information to the monitor with the clock pulse for recognizing the display type information included in the vertical sync signal. In FIG. 6, ① denotes the horizontal sync signal period.

Accordingly, the monitor reads the display type information carried on the horizontal sync signal according to the clock pulse included in the vertical sync signal using the vertical sync signal as an enable signal. The monitor then detects the display type information, and displays the RGB video signal to match the corresponding type.

Third Embodiment

According to the video information interfacing method in a computer system according to the third embodiment of the present invention, as shown in FIG. 6, the main body divides the display type information of the RGB video signal, and carries divided display type information on the horizontal sync signal, R video signal, G video signal or B video signal. By doing so, the display type information is synchronized with the vertical sync signal ③. The main body also transmits to the monitor the display type information with the clock pulse for recognizing the display type information included in the vertical sync signal. Thus the divided display type information can be embedded into the horizontal sync signal and the vertical sync signal, as well as the video signals. Additionally, the clock pulse for recognizing the display type information is preferably included in the vertical sync signal.

For example, the main body may divide the display type information into two, and carry the two pieces of divided information on the horizontal sync signal and R video signal, respectively. Also, the main body may divide the display type information into four divided parts of display type information, and carry the parts on the horizontal sync signal, R video signal, G video signal, and B video signal, respectively. Then, the main body transmits the divided display type information to the monitor with the clock pulse for recognizing the display type information included in the vertical sync signal.

Accordingly, the monitor reads the divided display type information carried on the horizontal sync signal, R video signal, G video signal, or B video signal according to the clock pulse included in the vertical sync signal using the vertical sync signal as an enable signal.

The monitor then combines the divided display type information and detects the contents of the combined display type information, and displays the RGB video signal on the display screen to match the corresponding type.

Fourth Embodiment

Figure 7:
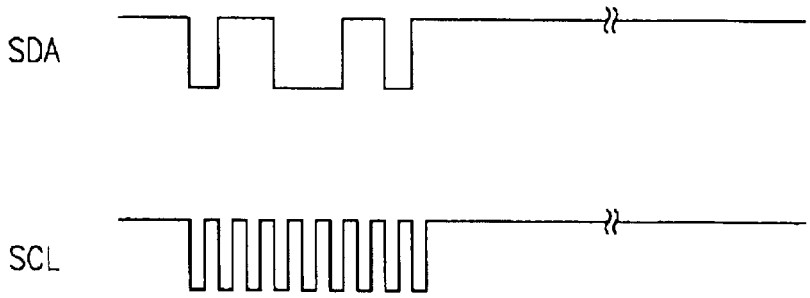
FIG. 7 is a waveform diagram showing the operation of the video information interfacing apparatus in a computer system according to a fourth embodiment of the present invention.

According to the video information interfacing method in a computer system according to the fourth embodiment of the present invention, as shown in FIG. 7, the monitor includes information regarding the display type of the video signal that can be displayed by the monitor, i.e., the factory mode information, in the serial data (SDA). The monitor transmits the serial data (SDA) to the main body along with the serial clock pulse (SCL).

The main body then detects the display type information transmitted from the monitor, and converts the RGB video signal to match the display type. It does this by recognizing the display type of the video signal that can be displayed normally by the monitor, and then transmits the RGB video signal along with the corresponding horizontal and vertical sync signals to the monitor.

Accordingly, the monitor detects the display type of the RGB video signal using the horizontal and vertical sync signals transmitted form the main body, and displays data on the display screen in the factory mode, which matches the display type among the predetermined factory modes.

Figure 8:
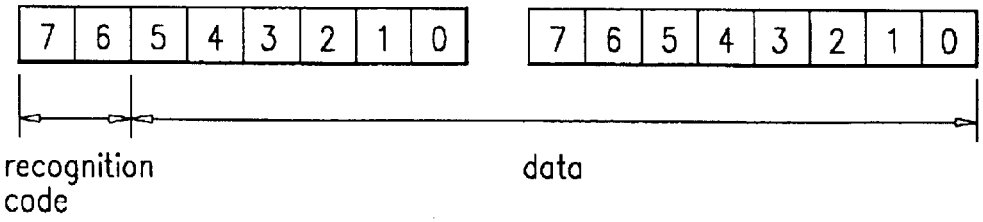
FIG. 8 is a drawing illustrating the format of the display type information according to one embodiment of the present invention.

According to the first to fourth embodiments of the present invention, various types of the display type information can be provided. Referring to FIG. 8, which exemplifies a type of the display type information, the information is composed of a total of 16 bits, including recognition codes of 2 bits and data of 14 bits.

The recognition code '00' represents information on the number of dots for one horizontal period. The recognition code '01' represents information on the number of back-porches for one horizontal period. The recognition code '10' represents information on the number of horizontal lines for one vertical period. The recognition code '11' represents information on the number of horizontal lines of a back-porch for one vertical period.

The display type information is preferably classified into 4, but the total number of bits and the bit number of the recognition code can be varied according to the number of the display type information.

As described above, according to the apparatus and method of interfacing video information in a computer system according to the various embodiments of the present invention, an optimum picture state can be achieved and maintained, irrespective of the display type of the monitor input video, through the exchange of the display type information between the main body and the monitor. The reliability of products can thus be improved.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An apparatus for interfacing video information in a computer system, comprising:

a main body, which outputs a video signal, a horizontal sync signal, a vertical sync signal, and video signal display type information identifying a video type of the video signal, the video signal display type information including a display code that designates the video signal display type, wherein the video signal display type information is divided to comprise divided display type information having at least two parts, and wherein the divided display type information is embedded into the horizontal sync signal and at least one of R, G, and B video signals forming the video signal, respectively; and a monitor, which detects the type of display for the corresponding video signal in accordance with the display type information, and displays the outputted video signal in accordance with the detected display type.

2. The apparatus of claim 1, wherein the display code comprises a recognition code that designates the video display type and data corresponding to the recognition code.

3. The apparatus of claim 1, wherein the vertical sync signal comprises a clock pulse for recognizing the display type information.

4. A video interface, comprising:

a main body, which provides information relative to a display type of a video signal, the information being divided to comprise divided display type information having at least two parts, wherein a first part of the divided display type information is embedded into a horizontal sync signal, and wherein a second part of the divided display type information is embedded into at least one of R, G, and B video signals comprising the video signal, respectively, and outputs the video signal, the horizontal sync signal and a vertical sync signal; and a monitor which detects the display type of the corresponding video signal in accordance with the display type information outputted from the main body, and displays the video signal in accordance with the detected display type, wherein the information relative to the display type comprises a display code that designates the video signal display type.

5. The interface of claim 4, wherein the display code comprises a recognition code that designates the signal display type and data corresponding to the recognition code.

6. The interface of claim 4, wherein the vertical sync signal comprises a clock pulse for recognizing the display type information.

7. A method of interfacing video information, comprising:

transmitting video signal display type information, horizontal and vertical sync signals, and a video signal from a main body to a monitor, the video signal display type information being divided to comprise divided display type information having at least two parts, and wherein a first part of the divided display type information is embedded into the horizontal sync signal, and wherein a second part of the divided display type information is embedded into at least one of R, G, and B video signals comprising the video signal, respectively, the video information display type information including a display code that designates a video display type; and detecting a display type of the video signal transmitted from the main body using the video signal display type information, and displaying the video signal to match the display type.

8. The method as claimed in claim 7, wherein the display type information comprises a recognition code for designating a kind of the corresponding display type information, and data corresponding to the recognition code.

9. The method as claimed in claim 8, wherein the recognition code is composed of two bits.

10. The method as claimed in claim 8, wherein the data includes a number of dots in a horizontal period, a number of backporches in the horizontal period, a number of horizontal lines in a vertical period, and a number of horizontal lines of a backporch in the vertical period.

11. The method of claim 7, wherein the display code comprises a recognition code that designates the video display type and data corresponding to the recognition code.

12. The method of claim 7, wherein the vertical sync signal comprises a clock pulse for recognizing the display type information.

13. A method of interfacing video information, comprising:

dividing display type information of a video signal into at least two parts;

transmitting divided display type information of the video signal in each of a horizontal sync signal and the video signal, respectively, from a main body, the display type information including a display code that designates the video signal display type; and detecting a display type of the transmitted video signal using the display type information.

14. The method as claimed in claim 13, wherein the main body synchronizes the display type information with the vertical sync signal.

15. The method as claimed in claim 13, further comprising transmitting a vertical sync signal from the main body to the monitor, wherein the vertical sync signal comprises a clock pulse for recognizing the display type information.

16. The method of claim 13, wherein the display code comprises a recognition code that designates the video signal display type and data corresponding to the recognition code.

17. A method of interfacing video information, comprising:

dividing display type information of R, G, B video signals, the display type information including a recognition code that designates the video signal display type and data corresponding to the recognition code;

embedding the divided display type information into a horizontal sync signal and at least one of the R, G, and B video signals, respectively;

transmitting to a monitor the horizontal sync signal, a vertical sync signal, and the video signals;

decoding and reassembling the display type information; and detecting a display type of the transmitted video signal using the reassembled display type information.

18. The method as claimed in claim 17, wherein the main body synchronizes the display type information with the vertical sync signal.

19. The method as claimed in claim 17, wherein a clock pulse for recognizing the display type information is included in the vertical sync signal.

20. A method of interfacing video information, comprising:

dividing display type information of a video signal, the display type information including a display code that designates a video signal display type;

embedding the divided display type information into at least one of a horizontal sync signal, an R video signal, a G video signal, and a B video signal;

embedding a clock pulse for recognizing the display type information in a vertical sync signal;

transmitting the horizontal sync signal, the R video signal, the G video signal, the B video signal, and the vertical sync signal from a main body to a monitor; and detecting the video signal display type using the display type information.

21. The method of claim 20, wherein the display code comprises a recognition code that designates the video display type and data corresponding to the recognition code.

22. An apparatus for interfacing video information, comprising:

a main body, which outputs a video signal and corresponding display type information, the display type information including a data-identifying recognition code that identifies a specific kind of the corresponding display type information, and data corresponding to the data-identifying recognition code; and a monitor, which detects a display type of the corresponding video signal in accordance with the display type information, and displays the video signal outputted from the main body in accordance with the detected display type, wherein the display type information is divided to comprise at least two parts, and wherein the divided display type information is embedded into a horizontal sync signal and at least one of the R, G, and B video signals, respectively.

23. A video interface, comprising:

a main body, which outputs a video signal through a video signal line, and outputs information relating to the video signal display type, the information relating to the video signal display type including a display code that designates the video signal display type, wherein the display code comprises a data-identifying recognition code that identifies a specific kind of the corresponding video signal display type information, and the information corresponding to the data-identifying recognition code; and a monitor, which detects the display type of the corresponding video signal in accordance with the display information, and displays the video signal outputted from the main body in accordance with the detected display type, wherein the information relating to the video signal display type is divided to comprise divided display type information having at least two parts, and wherein the divided display type information is embedded into a horizontal sync signal and at least one of the R, G, and B video signals, respectively.

24. A method of interfacing video information, comprising:

transmitting display type information of a video signal in communication data, along with horizontal and vertical sync signals from a main body to a monitor, the display type information comprising a display code that designates a video signal display type, wherein the display code comprises a data-identifying recognition code that identifies a specific kind of the corresponding display type information, and data corresponding to the data-identifying recognition code; and detecting a display type of the transmitted video signal using the display type information, and displaying the video signal to match the display type, wherein the display type information is divided to comprise divided display type information having at least two parts, and wherein at least one part of the divided display type information is embedded into one of a horizontal sync signal and at least one of the R, G, and B video signals, respectively.

25. An apparatus for interfacing video information in a computer system, comprising:

a main body, which outputs a video signal, a horizontal sync signal a vertical sync signal, and video signal display type information identifying a video type of the video signal, the video signal display type information including a display code that designates the video signal display type, wherein the video signal display type information is divided to comprise divided display type information having at least two parts, and wherein the divided display type information is embedded into the horizontal sync signal and at least one of R, G, and B video signals forming the video signal, respectively; and a monitor, which detects the type of display for the corresponding video signal in accordance with the display type information, and displays the outputted video signal in accordance with the detected display type, wherein the display type information is divided to comprise divided display type information having at least two parts, and wherein the divided display type information is embedded into a horizontal sync signal and at least one of the R, G, and B video signals, respectively.

* * * * *